US011305541B2

(12) United States Patent
Friedman et al.

(10) Patent No.: US 11,305,541 B2
(45) Date of Patent: Apr. 19, 2022

(54) INKJET PRINT HEADS CLEANING SYSTEM

(71) Applicant: Nano Dimension Technologies LTD., Nes Ziona (IL)

(72) Inventors: Tomer Friedman, Holon (IL); Salamon Mekonen, Nes Ziona (IL)

(73) Assignee: Nano Dimension Technologies, LTD., Nes Ziona (IL)

( * ) Notice: Subject to any disclaimer, the term of this patent is extended or adjusted under 35 U.S.C. 154(b) by 0 days.

(21) Appl. No.: 17/441,997

(22) PCT Filed: Mar. 23, 2020

(86) PCT No.: PCT/US2020/024191
§ 371 (c)(1),
(2) Date: Sep. 22, 2021

(87) PCT Pub. No.: WO2020/198129
PCT Pub. Date: Oct. 1, 2020

(65) Prior Publication Data

US 2022/0088930 A1 Mar. 24, 2022

Related U.S. Application Data

(60) Provisional application No. 62/822,296, filed on Mar. 22, 2019.

(51) Int. Cl.
*B41J 2/165* (2006.01)

(52) U.S. Cl.
CPC ..... *B41J 2/16526* (2013.01); *B41J 2/16552* (2013.01)

(58) Field of Classification Search
CPC .... B41J 2/16526; B41J 2/16552; B41J 2/165; B41J 2/16538; B41J 2002/16502
See application file for complete search history.

(56) References Cited

U.S. PATENT DOCUMENTS

| | | | |
|---|---|---|---|
| 9,878,549 | B1 | 1/2018 | Fima et al. |
| 2011/0050794 | A1 | 3/2011 | Koike et al. |
| 2011/0115844 | A1 | 5/2011 | Ozawa |
| 2013/0100199 | A1 | 4/2013 | Suzuki et al. |
| 2015/0217575 | A1 | 8/2015 | Kumagai et al. |

FOREIGN PATENT DOCUMENTS

| | | | | |
|---|---|---|---|---|
| EP | 0678389 B1 | * | 9/1998 | ..... B41J 2/16523 |
| JP | 2019001028 A | * | 1/2019 | |

* cited by examiner

*Primary Examiner* — Sharon Polk
(74) *Attorney, Agent, or Firm* — Guy Levi; The IP Law Firm of Guy Levi, LLC

(57) ABSTRACT

The disclosure relates to a portable system for cleaning ink jet print heads. Specifically, the disclosure relates to external, portable systems and jig assemblies for cleaning clogged nozzles of ink jet print head under controlled pressure. The jig assembly can be self-contained and detachable, and can be programmed to operate upon receiving various signals indicating clogged nozzle plate or portion thereof, and/or as a routine maintenance operating procedure.

22 Claims, 3 Drawing Sheets

INKJET PRINT HEADS CLEANING SYSTEM

CROSS REFERENCE TO RELATED APPLICATIONS

This patent application is a U.S. National Phase filing of commonly owned PCT Application No. PCT/US20/24191, filed Mar. 23, 2020, which is based on and claims the benefit of the filing date of U.S. Provisional Patent Application Ser. No. 62/822,296, filed Mar. 22, 2019, both which are incorporated herein by reference in their entirely. —

BACKGROUND

The disclosure is directed to a system for cleaning ink jet print heads. Specifically, the disclosure is directed to systems and assemblies for cleaning clogged nozzles of ink jet print head under controlled pressure.

Inkjet printing heads require periodic cleaning of printing nozzles to remove buildup (solid sediments) on the nozzles, remove air bubbles, and otherwise maintain printing quality. Cleaning the printing head is a significant part of the inkjet printing process, for example in some industrial settings the printing head is cleaned as often as every two minutes. The frequency of cleaning depends on the specific application for which the printing head is being used. Typically, cleaning can also be done by removing the print head to one side of the printer for easy access and cleaning the head either manually or using a wiper. These methods are time consuming and inefficient.

Typically, an orifice plate, is located on the printing side (lower surface) of the printing head, providing access for the nozzles to print, while potentially also providing protection for the printing head. Jetted ink from each nozzle exits the orifice for printing. During periodic cleaning and/or after purging, the orifice surface can be cleaned to remove buildup, purged liquid, and enable proper jetting of the printing liquid from the nozzles (via the orifices).

In order to preserve the smoothness and high interfacial tension between the printing side and the jetted ink and the orifice surface (non-wetting characteristic required for forming consistent drops), care must be taken in performing wiping, so as not to damage the orifice plate or reclog the nozzles. Likewise, current use of syringes with cleaning fluid to unclog nozzles is inconsistent, time consuming and potentially detrimental to the print heads.

These and other shortcomings of the current technology are addressed by the following disclosure.

SUMMARY

Disclosed, in various embodiments, are systems and assemblies for cleaning clogged nozzles of ink jet print head under controlled pressure.

In an embodiment provided herein is a computerized system for unclogging nozzle plate of an ink jet print head comprising: a pressure pump a pressure relief valve in fluid communication with the pressure pump; a cleaning liquid vessel in fluid communication with the pressure relief valve; an ink jet print head having an inlet, a drain outlet and a nozzle plate, the ink jet print head being in fluid communication with the cleaning vessel; a switch valve, the switch valve being in fluid communication with the ink jet print head and a bath; the bath; a filter module in fluid communication with the switch valve; a recirculating pump in fluid communication with the filter module and the cleaning liquid vessel; and a central processing module (CPM), in communication with the pressure pump, the pressure relief valve, the ink jet print head, the switch valve, the filter module, and the recirculating pump.

In another embodiment, provided herein is a computerized method of unclogging an ink jet print head nozzle plate, implementable in a system comprising: a pressure pump, a pressure relief valve in fluid communication with the pressure pump, a cleaning liquid vessel in fluid communication with the pressure relief valve, an ink jet print head having an inlet, a drain outlet and a nozzle plate, the ink jet print head being in fluid communication with the cleaning vessel, a switch valve, the switch valve being in fluid communication with the ink jet print head and a bath, the bath, a filter module in fluid communication with the switch valve, a recirculating pump in fluid communication with the filter module and the cleaning liquid vessel, a pressure gauge (e.g., a hydrostatic gauge, an aneroid gauge, a piezoresistive strain gauge, a capacitive manometer, a cold cathode gauge, a thermocouple gauge, and the like and their combination) in communication with the filter module, and a central processing module (CPM), in communication with the pressure pump, the pressure relief valve, the ink jet print head, the switch valve, the filter module, and the recirculating pump, the method comprising: upon at least one of: at a fixed time interval of the ink jet print head printing; receiving a command by the CPM; and receiving a signal indicating the ink jet print head nozzle plate is clogged activating the pressure pump, and the recirculating pump as well as actuating the switch valve; circulating the cleaning fluid through the ink jet print head inlet to the drain outlet, through the switch valve to the filter module and to the cleaning fluid vessel; actuate the switch valve for circulating the cleaning fluid through the ink jet print head nozzle plate and into the bath; and upon at least one of: a predetermined lapse of time; and receiving a command by the CPM, shutting the pressure pump, actuating the switch valve, and closing the relief valve thus draining the fluid from the bath, through the filter module to the cleaning fluid vessel.

In another embodiment, the set of executable instruction is configured, when executed, to cause the CPM to: using the pressure pump, pressurize the cleaning fluid vessel, causing cleaning fluid to flow into the ink jet print head's inlet; and actuate the switch valve and the recirculating pump, circulating the cleaning fluid through the filter module, to the cleaning fluid vessel, the ink jet print head inlet, and the ink jet print head drain outlet; actuate the switch valve, circulating the cleaning fluid through the ink jet print head nozzle plate and into the bath, and from the bath, through the switch valve to the filter module and to the cleaning fluid vessel; and stop the pressure valve, actuate the switch valve, and close the relief valve, circulating the fluid from the bath to the cleaning fluid vessel.

In yet another embodiment the step of actuating the switch valve and the recirculating pump is preceded by: printing a test pattern; and analyzing the test pattern; determining if the nozzle plate is clogged; and if the nozzle plate is clogged, then coupling the cleaning liquid vessel in fluid communication with the pressure relief valve to the ink jet print head's inlet, and the switch valve, the filter module and the recirculating pump to the drain outlet while placing the bath beneath the ink jet print head's nozzle plate; else using the ink jet print head.

These and other features of the assemblies and methods for inkjet print heads alignment, will become apparent from the following detailed description when read in conjunction with the figures and examples, which are exemplary, not limiting.

BRIEF DESCRIPTION OF THE FIGURES

For a better understanding of the systems and assemblies for cleaning clogged nozzles of ink jet print head under controlled pressure, with regard to the embodiments thereof, reference is made to the accompanying examples and figures, in which.

DETAILED DESCRIPTION

Figure 1:
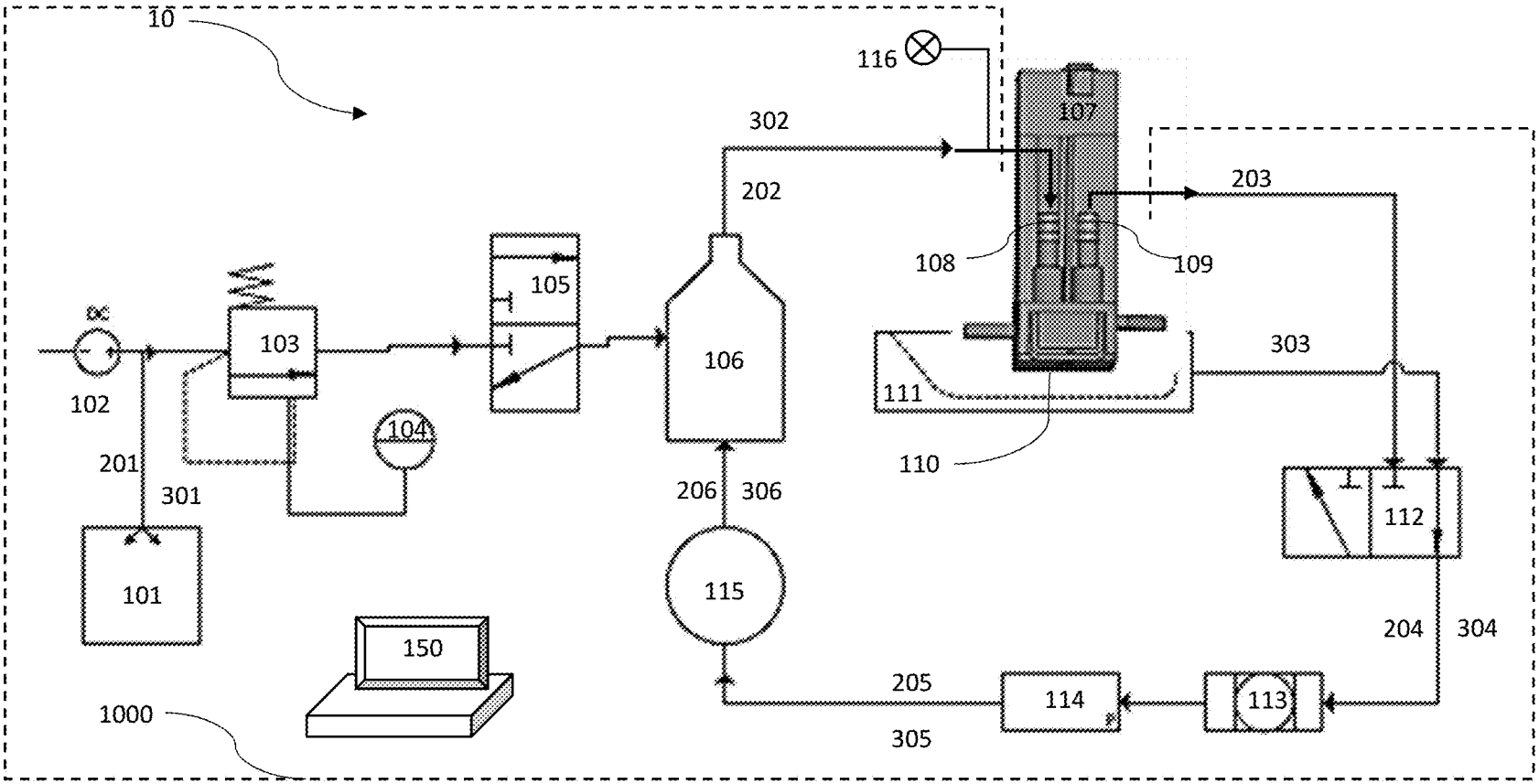
FIG. 1 is a schematic representation of the system's components.

Provided herein are embodiments of systems and assemblies for cleaning clogged nozzles of ink jet print head under controlled pressure.

One type of ink jet printer is the "on demand" ink jet printer. "On demand" ink jet printers eject ink droplets only when needed to form the desired pattern. In one form of "on demand" ink jet printer, a plurality of ink jet nozzles is provided along with a plurality of pressurization actuators for every nozzle. The plurality of pressurization actuators are used to produce the ink jet droplets. For example, the actuator(s) can be: heat actuators and piezoelectric actuators. In heat actuators, a heater is disposed in the ink jet nozzle and heats the ink. This causes a quantity of the ink to undergo phase change into a gaseous bubble and raise the internal ink pressure sufficiently for an ink droplet to be expelled onto the recording medium.

Conversely, in piezoelectric actuators, a piezoelectric material is provided for every nozzle. The piezoelectric material possesses piezoelectric properties such that an applied electric field will produce a mechanical stress in the material resulting in some deformation (in other words, electrostriction). Some naturally occurring materials possessing these characteristics are quartz and tourmaline. The most commonly produced piezoelectric ceramics are lead zirconate titanate, barium titanate, lead titanate, and lead metaniobate. When these materials are used in an inkjet print head, they apply mechanical stress upon the ink in the print head to cause an ink droplet to be ejected from the print head.

Furthermore, the ink jet print head is exposed to the environment where the ink jet printing occurs. Thus, print head orifices and surface are exposed to many kinds of airborne particulates and other environmental constraints that affect the shape of the orifices, leading to inconsistencies in print quality. Particulate debris may accumulate on the print head surface surrounding the orifices and may accumulate in the orifices and chambers themselves. Also, ink may combine with such particulate debris to form an interference burr that blocks the orifice or that alters surface wetting to inhibit proper formation of the ink droplet. Of course, the particulate debris should be cleaned from the surface and orifice to restore proper droplet formation.

Ink jet print head cleaners are known. An ink jet print head cleaner is disclosed in U.S. Pat. No. 4,970,535 titled "In Jet Print Head Face Cleaner" issued Nov. 13, 1990 discloses an ink jet print head face cleaner that provides a controlled air passageway through an enclosure formed against the print head face. Air is directed through an inlet into a cavity in the enclosure. The air that enters the cavity is directed past ink jet apertures on the head face and out an outlet. A vacuum source is attached to the outlet to create a sub-atmospheric pressure in the cavity. A collection chamber and removable drawer are positioned below the outlet to facilitate disposal of removed ink. However, the use of heated air is not a particularly effective medium for removing dried particles from the print head surface. Similar approach is disclosed in commonly owned U.S. Pat. No. 9,878,549, titled "Devices, Systems and Methods for Ink Jet Print Head Maintenance", directed to structurally integrated mechanical systems and methods for removing purged ink from inkjet print head without contacting the aperture plate with liquid or other mechanical means. The system creates a Venturi effect between the print head and the collection bath. Neither of these systems are portable, nor do these systems attempt to unclog orifices.

Another way is to use a cleaning fluid to clean a print head, known as wet wiping. In wet wiping, cleaning fluid is applied to the print head's underside and a wiper is used to clean the cleaning fluid and contaminants from the print head. Examples of various wet wiping embodiments are found in Rotering et al. U.S. Pat. No. 5,914,734, where a structurally integrated cleaning station is utilized to apply a metered amount of cleaning fluid to the print head and to wipe cleaning fluid and contaminants from the print head. Similar approach is disclosed in commonly owned PCT/US19/42540, titled "Contactless Inkjet Print head maintenance" directed to an assembly used for cleaning the print heads from ink build up. The assembly uses a sequence of washing and baths sized and configured to remove ink buildup from each print head, collect the CI for reclamation, and the DI for disposal. The system further details the recycling sequence. Here too, the systems are integrated with the printer and cleaning is directed opposite the droplet expulsion direction, in other words, from the orifice plate to the print head's reservoir.

In an exemplary implementation, provided herein is an external, portable computerized system for unclogging nozzle plate of an ink jet print head comprising: a pressure pump a pressure relief valve in fluid communication with the pressure pump; a cleaning liquid vessel in fluid communication with the pressure relief valve; an ink jet print head having an inlet, a drain outlet and a nozzle plate, the ink jet print head being in fluid communication with the cleaning vessel; a switch valve, the switch valve being in fluid communication with the ink jet print head and a bath; the bath; a filter module in fluid communication with the switch valve; a recirculating pump in fluid communication with the filter module and the cleaning liquid vessel; and a central processing module (CPM), in communication with the pressure pump, the pressure relief valve, the ink jet print head, the switch valve, the filter module, and the recirculating pump. The system can further comprise at least one of: a first pressure gauge in communication with the pressure relief valve, a second pressure gauge in communication with the filter module, and a third pressure gauge in communication with the ink jet print head. For example, the system can comprise a single pressure gauge, the pressure gauge being in fluid communication with the filter module and configured to provide indication on the condition of the filter module, in other words, whether or not the filter module is blocked by the recirculating ink impurities and polymerized ink. For example, if the pressure gauge is upstream from the filter module (in other words, measuring pressure at the inlet of the filter module, the blocked filter module will cause backpressure upstream of the inlet and an increase in pressure of between about 0.25 to 0.49 Atm. can be used as the indication for blocked filter. Alternatively, if the pressure gauge is downstream to the filter module, the same pressure drop can be used to indicate a blocked filter module.

The system can be controlled to be limited up to 1 Bar, or, in other words, the system is sized, adapted (in other words, the system, step/component is preferably tailored to the particulars of the function) and configured to limit the pressure generated inside the print head and across the nozzle plate, will be up to 1 bar, while in the typical manual process implemented in a non-controlled systems such as the disclosed system, there isn't any indication what is the pressure applied, since it's not controlled. The pressure induced by the system is maintained for example between about 0.5 Bar (0.494 Atm.) and up to 1 Bar (0.987 Atm).

Figure 3A:
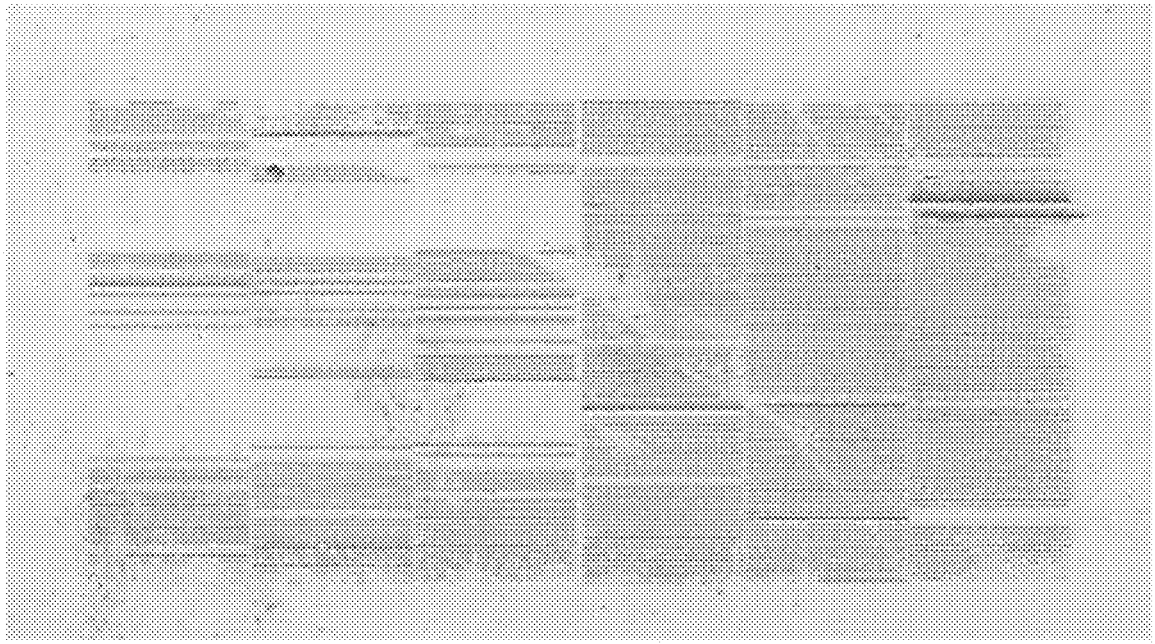
FIG. 3A shows a test print pattern before attaching the jig and forming the system.

In addition, the systems and assemblies described herein have a recycling mechanism and runs automatic program sequences, which is configured, when executed, to automatically perform the cleaning process upon the passage of a predetermined time, or, in another exemplary implementation, after detection of a reduction in overall print quality (due e.g., on clogged nozzles, see e.g., FIG. 3A).

Figure 3B:
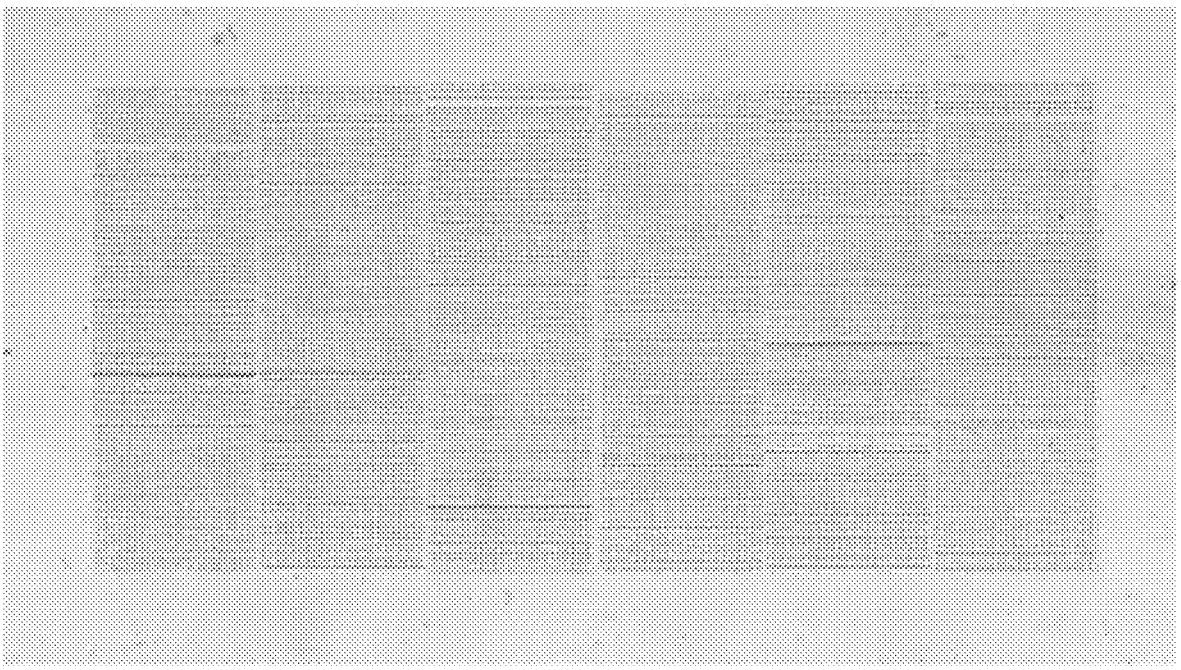
FIG. 3B shows the test print after cleaning using the systems and methods provided herein.

Print quality is a parameter that can be measured in a variety of ways well known to the skilled artisan and may provide a user-determined threshold or trigger for initiation of the cleaning sequence. As used herein, the term "print quality" refer in certain examples to subjective and/or objective qualities of a print generated by applying ink to a print substrate. Example objective qualities that may increase print quality include an accuracy of the application of ink to the substrate, droplet size accuracy, etc. For example, a sharpness of an edge may be increased by reducing the ink droplet size, increasing the application of the ink droplets along the edge, and/or increasing an alignment of the ink droplets along the edge, thereby also increasing a subjective print quality. Subjective print quality refers to personal preferences, perceptions, and/or qualities that are in the eye of the beholder. While some objective qualities, such as accuracy of print (e.g., drop-on-drop, volume/drop, circularity), may also affect a subjective print quality, the example methods, apparatus, and articles of manufacture may not necessarily control or affect these other qualities. Other parameters used to evaluate print quality can be mean time between cleanings, (MTBC), repeatability of calibration patterns, print layer thickness along one, two or three dimensions and the like. Print quality can be determined by, for example, printing a test patter such as the one shown in FIG. 3A (before cleaning using the system), and FIG. 3B (after using the system as described herein).

In an exemplary implementation, the system, except for the ink-jet print head is configured as a jig, inclusive of such constituent elements, otherwise indicated, which is sized and operable as a stand-alone, external sub-system that can be selectably (in other words, without affecting the operability of the ink-jet print head and/or the printer), and reversibly coupled to the ink-jet print head as needed. Accordingly in an exemplary implementation, the jig sub-system is contained in a housing 1000 (see e.g., FIG. 1), adapted sized and configured to comprise the pressure pump, the pressure relief valve in fluid communication with the pressure pump; the cleaning liquid vessel in fluid communication with the pressure relief valve; the switch valve, the switch valve adapted sized and configured (e.g., using the proper tubes and couplers) to couple to the ink jet print head, maintaining fluid communication. The Jig also comprises the bath, the filter module in fluid communication with the switch valve; the recirculating pump in fluid communication with the filter module and the cleaning liquid vessel; and the central processing module (CPM), in communication with the pressure pump, the pressure relief valve, the switch valve, the filter module, and the recirculating pump. The jig can be provided in as a discrete assembly, which can be maneuvered to the ink-jet print head, or as an integral part of a larger printer comprising the ink-jet print head. Accordingly and in an exemplary implementation, provided herein is a jig assembly for unclogging, or otherwise performing maintenance on the ink-jet print head's nozzle plate, the assembly comprising the cleaning fluid vessel, the relief valve, the switch valve, the bath, the pressure pump, the recycling pump, the filter module, and the bath—all of the foregoing in communication with the CPM. The jig further comprising the tubes, couplings, circuitry, check valves and pressure gauge, such that the jig can form the system described herein upon coupling to the ink-jet print head inlet and drain outlet.

The cleaning process can be configured to run for a predetermined period, for example between about 5 minutes and about 30 minutes, or between about 15 minutes and about 30 minutes, more specifically between about 5 minutes and about 15 minutes, or between about 25 minutes and about 30 minutes, depending on the programmed routine selected by either a final user, or the system based on detected pressures and pressure drop along the system's various pipes as described herein. These routines can be configured to execute automatically on a selected schedule, and/or ad or, upon actuation by the user, for example following detection of deterioration in the print quality done, for example by printing the test pattern shown in FIG. 3A.

A more complete understanding of the components, processes, and assemblies disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary implementations. Although specific terms are used in the following description for the sake of clarity, these terms are intended to refer only to the particular structure of the exemplary implementations selected for illustration in the drawings, and are not intended to define or limit the scope of the disclosure. In the drawings and the following description below, it is to be understood that like numeric designations refer to components of like function.

Turning now to FIG. 1, illustrating computerized system 10 for unclogging the ink-jet print head's nozzle plate 110 of ink jet print head 107 comprising: pressure pump 101 having pressure regulator 103 operably coupled thereto, and pressure relief valve 105 in fluid communication with pressure pump 101 and pressure regulator 103, connected to power source 102, for example a 24 V battery. Also illustrated is cleaning liquid vessel 106 in fluid communication with pressure relief valve 105. Ink jet print head 107 having inlet 108, drain outlet 109 and nozzle plate 110, the ink jet print head 107 being in fluid communication with the cleaning liquid vessel 106 with switch valve 112. Switch valve 112 being in fluid communication with the ink jet print head 107 and bath 111. Also shown is filter module 113 in fluid communication with switch valve 112. Recirculating pump 115, illustrated in fluid communication with the filter module 113 (for example, a 3 μm filter, configured to filter residue and solidified ink for example) and cleaning liquid vessel 106. In addition, central processing module (CPM) 150, in communication with pressure pump 101, pressure relief valve 105, optionally—ink jet print head 107, switch valve 112, filter module 113, and recirculating pump 115. Furthermore, system 10 can have a sensor array located along the various fluid paths as will be described herein. For example, first pressure gauge 104, coupled to pressure regulator 103 and pressure relief valve 105, second pressure gauge, for example, an in line pressure gauge 114, operably coupled between filter module 113 and recirculating pump 115. In another example in line pressure gauge 114, can be operably coupled between filter module 113 and switch valve 112. Also shown is optional third pressure gauge 116, for example pressure sensor, operably coupled to the conduit (202, 302) upstream from ink jet print head 107 inlet 108. Other sensors can be, for example, an overflow sensor coupled to bath 111, being operable to prevent liquid overflow in case of failure. Such overflow can occur for example in case of a clogged filter in filter module 113, and/or recirculating pump 115 failure and/or clogged pipes. Accordingly and in an exemplary implementation, system 10 further comprises at least one of: a first pressure gauge 104 in communication with pressure relief valve 105, second pressure gauge 114 in communication with the filter module, and a third pressure gauge 116 operably coupled to the conduit (202, 302) upstream from ink jet print head 107 inlet 108. In other exemplary implementations, only pressure gauge 114 is used in system 10. CPM 150 is configured to receive data and maintain communication with the pressure gauges, as well as any other sensor in the system. Likewise, CPM 150 is configured to control the operation of relief valve 105 and switch valve 112, thus controlling the flow of the cleaning liquid from cleaning liquid vessel 106, as executed using the programs provided.

Although not shown, system 10 can further comprise other components that may be in electronic communication with CPM 150 and be used in order to determine initiation and/or termination of either the draining sequence 201-206, or the unclogging sequence 301-306. Accordingly and in an exemplary implementation, system 10 further comprises at least one of: an imaging module and a calibration module, the imaging module and the calibration module configured, each or in combination to detect a clogged nozzle plate, and the command to either initiate or terminate the draining (201-206) and/or the unclogging (301-306) sequences, is provide through the imaging module and/or the calibration module.

The term "module", as used herein for example CPM 150, filter module 113, denotes, but is not limited to, a software component, a hardware component, an electromechanical device, an AD converter, a DA converter and the like, appropriate circuitry or a combination comprising one or more of the foregoing, which performs certain tasks. A module may advantageously be configured to reside on the addressable storage medium/media and configured to execute on one or more processors. Thus, a module may include, by way of example, components, such as software components, application specific software component, object-oriented software components, class components and task components, processes, functions, operations, execution threads, attributes, procedures, subroutines, segments of program code, drivers, firmware, microcode, circuitry, data, databases, data structures, tables, arrays, and variables. The functionality provided for in the components or module, may be combined into fewer components or modules or may be further separated into additional components or modules as well as devices, instruments, systems or sub-systems associated with a particular task. Further, the components or modules can operate at least one processor (e.g. central processing unit (CPU) provided in a device. In addition, examples of a hardware component include an application specific integrated circuit (ASIC) and Field Programmable Gate Array (FPGA). As indicated above, a module can also denote a combination of a software component(s) and a hardware component(s). Furthermore, the term "module" may refer to sub-systems or systems configured and adapted to perform various tasks.

Likewise, in the context of the disclosure, the term "imaging module" means a unit that includes a plurality of built-in image sensors and outputs electrical signals, which have been obtained through photoelectric conversion, as an image, while the term "module" refers to software, hardware, for example, at least one processor, or a combination thereof that is programmed with instructions for carrying an algorithm or method. The modules described herein may communicate through a wired connection, for example, a hard-wired connections, a local area network, or the modules may communicate wirelessly. The imaging module may comprise line cameras, laser scanners, charge coupled devices (CCDs), a complimentary metal-oxide semiconductor (CMOS) or a combination comprising one or more of the foregoing. For example, the imaging module can comprise a line scan camera and the field of view, will be determined by a predetermined scan period. If static images are required, the imaging module can comprise a digital frame camera, where the FOV (see e.g., FIG. 3A) can be predetermined by, for example, the camera size and the distance from the pattern used to measure PQ. The cameras used in the imaging modules of the systems and methods disclosed, can be a digital camera. The term "digital camera" refers in an embodiment to a digital still camera, a digital video recorder that can capture a still image of an object and the like. The digital camera can comprise an image capturing unit or module, a capture controlling module, a processing unit (which can be the same or separate from the central processing module for the printer), a display module and an operating module. Capturing the image can be done with, for example image capturing means such as a CCD solid image capturing device of the full-frame transfer type, and/or a CMOS-type solid image capturing device, or their combination.

In an exemplary implementation, system 10 CPM 150 can also comprise user interface module, a display, a processor; and a non-volatile memory having thereon a processor readable medium with a set of executable instructions. As indicated, CPM 150 can further comprise user interface module, whereby, "user interface module" broadly refers to any visual, graphical, tactile, audible, sensory, or other means of providing information to and/or receiving information from a user or other entity. Likewise, the display can be a part or a display module, which can include display elements, acting as a display. A typical example is a Liquid Crystal Display (LCD). LCD for example, includes a transparent electrode plate arranged on each side of a liquid crystal. There are however, many other forms of displays, for example OLED displays and Bi-stable displays. New display technologies are also being developed constantly. Therefore, the term display should be interpreted widely and should not be associated with a single display technology. Also, the display module may be mounted on a printed circuit board (PCB) of an electronic device, arranged within a protective housing and the display module is protected from damage by a glass or plastic plate arranged over the display element and attached to the housing.

For example, and in an exemplary implementation, system 10 is configured to limit the pressure across nozzle plate 110 of ink jet print head 107 to 1 Bar maximum, to prevent damage to the nozzle plate 110 (above 1 bar the nozzles in nozzle plate 110 may be damaged), while the minimum pressure, configured to open clogged nozzles in nozzle plate 110 configured to be maintained at about 0.5 Bar.

As needed, and in an example, the system is configured to operate and execute (either automatically, or selectably) at least two discrete routines. The first routine, can be a drain cleaning sequence, whereby, the set of executable instruction, when executed either automatically, and/or by the user through the user interface as described herein, is configured, when executed, to cause the CPM to: using pressure pump 101, pressurize 201 the cleaning fluid vessel 106, causing cleaning fluid to flow 202 into ink jet print head's 107 inlet 108 actuate switch valve 112 and recirculating pump 115, circulating the cleaning fluid out 203 of drain outlet through switch valve 112 and into 204 filter module 113, through 206 recirculating pump 115 and back to cleaning fluid vessel 106, and back through ink jet print head inlet 108, and ink jet print head drain outlet 109. In the drain cleaning sequence—cleaning liquid pass from ink jet print head inlet 108 through ink jet print head drain outlet 109 and back to cleaning fluid vessel 106. In the sequence, the pressure can rise gradually up to 0.5 Bar due to lower flow resistance, since there is no flow across any clogged nozzles in nozzle plate 110. This sequence can be used at a higher frequency and for a shorter time, which can be programmed through CPM 150, and user interface module.

Moreover, in the unclogging sequence, the set of executable instruction is configured, when executed, to cause CPM 150 to: using pressure pump 101, pressurize 301 cleaning fluid vessel 106, causing cleaning fluid to flow 302 into ink jet print head's inlet 108; and actuate switch valve 112 and recirculating pump 115, thus circulating the cleaning fluid through ink jet print head nozzle plate 110 and into bath 111, and from bath 111, through 303 switch valve 112 to filter module 113 and 304 back 306 to cleaning fluid vessel 106. As indicated, in the unclogging sequence (301-306)—washing liquid Pass from ink jet print head inlet 108 through nozzle plate 110 to bath 111 and back to cleaning fluid vessel 106. In this scenario the pressure is configured to reaches gradually 1 bar maximum, which is effective pressure opening the clogged nozzles. It is noted, that relief valve 105 is unchangeable and releases any accumulated system pressure for both the unclogging cycle and the drain cycle, of both the pipeline and cleaning fluid vessel 106. Relief valve 105 logic (as e.g., controlled by CPM 150), while the pressure pump is in the OFF position, is configured to be open (to atm. pressure), for example, opened between (draining and/or unclogging) sequences as well as at the end of the programs. The unclogging sequence (301-306), can be run either independently, and/or at a predetermined frequency as a function of the operation of the draining sequence. The duration of the unclogging sequence can be determined by CPM 150 either by a predetermined recycling time, and/or as limited by monitoring the pressure drop across all or some of the pressure gauges in the system. For example, a sharp pressure drop in first pressure gauge 104, can indicate the unclogging of nozzles since the back pressure caused by clogged nozzles in nozzle plate 110 has been reduced by the unclogging.

Accordingly and in an exemplary implementation, CPM 150 is configured to, at least one of: circulate the cleaning fluid at a fixed time interval for a predetermined period, and circulate the cleaning fluid in response to a signal received from at least one of the first 104, second 114 and third 116 pressure gauges. Furthermore, the set of executable instruction is configured, when executed, to cause CPM 150 to: in response to a signal received by CPM 150 (e.g., a time lapse, and/or a pressure drop/increase of more than a predetermined degree (for example 0.2-0.5 Bar) in at least one of: the first 104, second 114, third 116 pressure gauges, and across a combination thereof), stop recirculating pump 115; stop pressure pump 101; and using pressure relief valve 105, release residual system pressure (in other words, any pressure remaining in cleaning fluid vessel 106, and the pipelines following the shutdown of pressure pump 101 and recirculating pump 115). In another example, drop in pressure measured in (in-line e.g.,) pressure gauge 116 operably coupled to the conduit (202, 302) upstream from ink jet print head 107 inlet 108, indicates unclogging of the nozzles in nozzle plate 110, allowing for early termination of the cleaning cycle(s), or the extension of the cycles further in those circumstances where pressure drop is not observed. Moreover, a sharp increase in the signal observed in pressure gauge 116, may be used to indicate a malfunction in relief valve 103, or an extensive blockage of the nozzles in nozzle plate 110. It is noted that the rate of decrease/increase in the pressure measured in pressure gauge 116 can be used as the signal for CPM 150 to further control the system.

In an exemplary implementation, the system and draining sequence is used for example after at least one of, changing ink type in ink jet print head 107, routinely, and following long periods of either operation, or long period of shut down.

While showing line pumps, other drivers can be used to affect the actuation of the various parts. These include servo motors, pneumatic actuators and the like.

Figure 2:
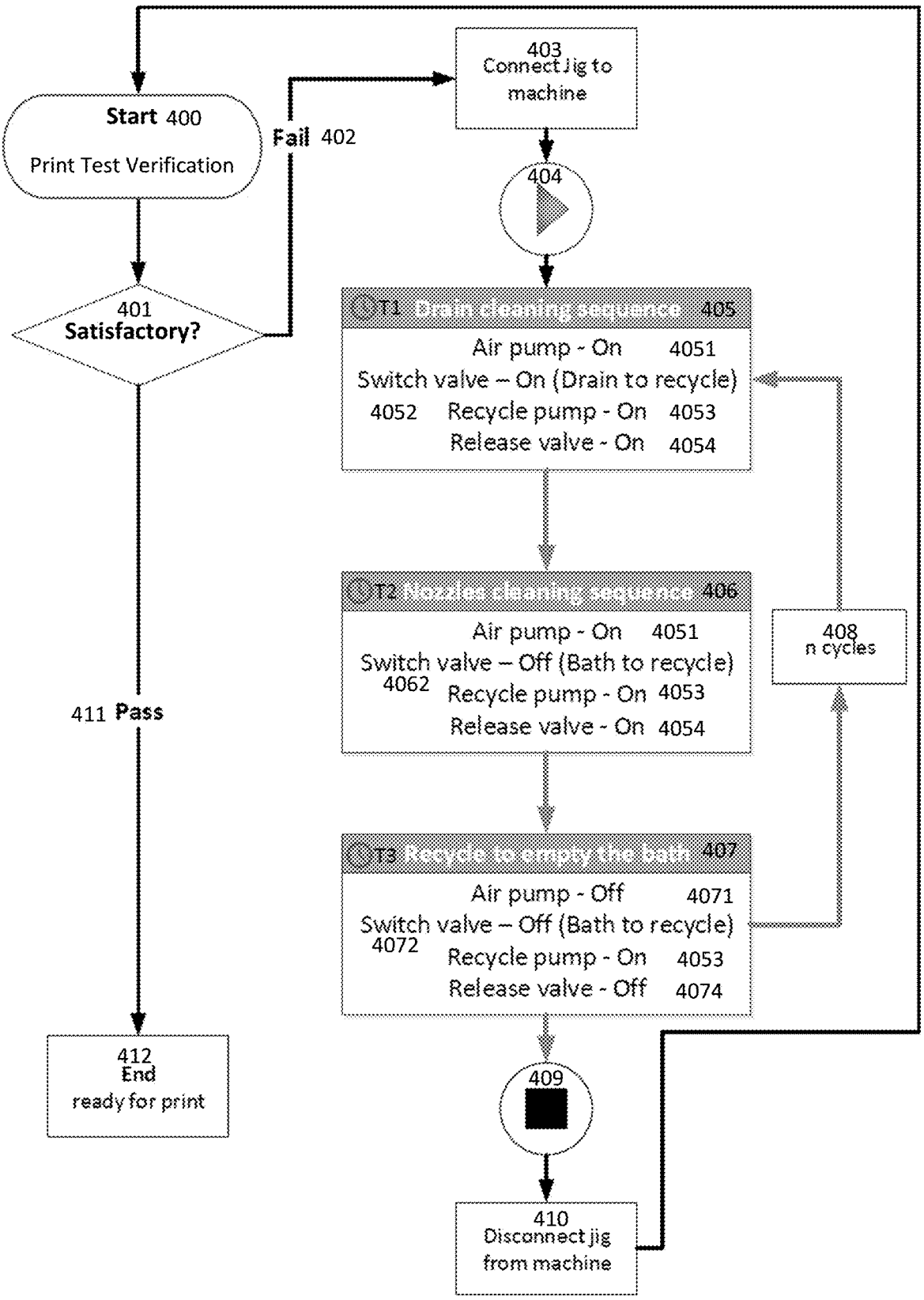
FIG. 2 is a flow chart illustrating an embodiment of the system's operation.

In an exemplary implementation, the methods provided herein are implemented using the systems described herein. Accordingly and in an exemplary implementation, as illustrated in FIGS. 1, and 2, provided herein is a computerized method of unclogging an ink jet print head nozzle plate, implementable in the systems described herein after connecting 403 the jig to the ink jet print head 107 inlet 108 (see e.g., FIG. 1) and drain outlet 109 as described above, the method comprising: upon at least one of: at a fixed time interval of the ink jet print head printing; receiving a command by the CPM; and receiving a signal indicating the ink jet print head nozzle plate is clogged, initiating drain cleaning sequence 405, by turning on 4051 pressure pump 101 actuating 4052 the switch valve 112 and (turning on 4053) the recirculating pump 115, thereby circulating the cleaning fluid through the ink jet print head 107 inlet 108 and drain outlet 109, through switch valve 112 to filter module 113 and to the cleaning fluid vessel 106, then switching to the nozzle cleaning sequence 406, maintaining pressure pump 101 on, 4051 as well as recirculating 4052 pump 115 by actuating 4062 switch valve 112 for circulating the cleaning fluid through the ink jet print head 107 nozzle plate 110 and into the bath 111; and upon at least one of: a predetermined lapse of time $T_2$; and receiving a command by the CPM; actuating the bath draining sequence, by turning 4071 pressure pump 101 off, actuating 4072 the switch valve 112, maintaining the recirculating pump 115 on 4053; and closing the relief valve thus draining the fluid from the bath 111, through filter module 113 to the cleaning fluid vessel. At that point the CPM can be stopped 409 and the jig disconnected 410.

Connecting the jig to print head 107 inlet 108, drain outlet 109 and placing bath 111 beneath nozzle plate 110, is done in certain configurations after printing 400 of test pattern (see e.g., FIG. 3A), and determining whether the print quality (PQ) is satisfactory 401, whereupon determination that the PQ is not satisfactory 402, jig 10 can be either connected 403 to the tested ink jet print head's 107 inlet 108, to drain outlet 109 and whereby bath 111 is placed beneath nozzle plate 111 of ink jet print head 107, or, in certain implementations, as an integral part of the printing system (not shown), the printing can be stopped and the drain cleaning sequence commenced 404. It is noted, that the drain cleaning sequence 405 is configured to be carried out (recirculation of the cleaning fluid through drain outlet 108 through filter and back), for a period of between about 30 seconds and about 180 seconds, while the nozzle cleaning sequence 406 is configured to be carried out (recirculation of the cleaning fluid through nozzle plate 110 to the bath), for a period of between about 120 seconds and about 420 seconds. Likewise, the bath draining sequence 407, can be carried out (draining bath 111 through filter module 113 and back to cleaning fluid vessel 106), for a period of between about 30 seconds and 60 seconds.

Furthermore, the three sequences 405, 406, and 407 can be carried out for several cycles, for example, between 3 and 7 cycles, followed by printing of an additional test pattern (see e.g., FIG. 3A, 3B), whereupon determining 401 that the PQ is satisfactory 411, the cleaned and otherwise refurbished ink jet print head is ready 412 for printing. In the context of the subject disclosure, following the cleaning process, the cleaned print head, having a satisfactory PQ relative to an initially unsatisfactory PQ, is considered as "refurbished" print head's nozzle plate 110.

Terms and phrases used in this document, and variations thereof, unless otherwise expressly stated, should be construed as open ended as opposed to limiting. As examples of the foregoing: the term "including" should be read as meaning "including, without limitation" or the like; the term "example", "implementation", or "exemplary implementation" is used to provide exemplary instances of the item in discussion, not an exhaustive or limiting list thereof; and adjectives such as "conventional," "traditional," "normal," "standard," "known", "typical" and terms of similar meaning should not be construed as limiting the item described to a given time period or to an item available as of a given time, but instead should be read to encompass conventional, traditional, normal, or standard technologies that may be available or known now or at any time in the future.

The terms "first," "second," and the like, when used herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the head(s) includes one or more head). Reference throughout the specification to "one exemplary implementation", "another exemplary implementation", "an exemplary implementation", and so forth, means that a particular element (e.g., feature, structure, and/or characteristic) described in connection with the exemplary implementation is included in at least one exemplary implementation described herein, and may or may not be present in other exemplary implementations. In addition, it is to be understood that the described elements may be combined in any suitable manner in the various exemplary implementations.

In addition, for the purposes of the present disclosure, directional or positional terms such as "top", "bottom", "upper," "lower," "side," "front," "frontal," "forward," "rear," "rearward," "back," "trailing," "above," "below," "left," "right," "radial," "vertical," "upward," "downward," "outer," "inner," "exterior," "interior," "intermediate," etc., are merely used for convenience in describing the various exemplary implementations of the present disclosure.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process (e.g., an electromagnetic field). Indirect coupling may involve coupling through an intermediary member or adhesive, or abutting and otherwise resting against, whether frictionally (e.g., against a wall) or by separate means without any physical connection.

In relation to systems, devices and jigs, the term "operable" means the system and/or the device and/or the jig is fully functional and calibrated, comprises elements for, and meets applicable operability requirements to perform a recited function when activated or when an executable program is executed by at least one processor associated with the system and/or the device and/or the jig. In relation to systems and circuits, the term "operable" means the system and/or the circuit is fully functional and calibrated, comprises logic for, and meets applicable operability requirements to perform a recited function when executed by at least one processor.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

All ranges disclosed herein are inclusive of the endpoints, and the endpoints are independently combinable with each other. Likewise, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

The term "computer-readable medium" as used herein, in addition to having its ordinary meaning, refers to any medium that participates in providing instructions to a processor for execution. Such a medium may take many forms, including but not limited to, non-volatile media and volatile media. Non-volatile media can be, for example, optical or magnetic disks, such as a storage device. Volatile media includes dynamic memory, such as main memory.

Memory device as used in the methods, programs and systems described herein can be any of various types of memory devices or storage devices. The term "memory device" is intended to encompass an installation medium, e.g., a CD-ROM, floppy disks, or tape device; a computer system memory or random access memory such as DRAM, DDR RAM, SRAM, EDO RAM, Rambus RAM, etc.; or a non-volatile memory such as a magnetic media, e.g., a hard drive, optical storage, or ROM, EPROM, FLASH, etc. The memory device may comprise other types of memory as well, or combinations thereof. In addition, the memory medium may be located in a first computer in which the programs are executed (e.g., the 3D inkjet printer provided), and/or may be located in a second different computer [or micro controller] which connects to the first computer over a network, such as the Internet. In the latter instance, the second computer may further provide program instructions to the first computer for execution. The term "memory device" can also include two or more memory devices which may reside in different locations, e.g., in different computers that are connected over a network.

Accordingly and in an implementation, provided herein is a portable computerized system for unclogging and refurbishing nozzle plate of an ink jet print head comprising: a pressure pump a pressure relief valve in fluid communication with the pressure pump; a cleaning liquid vessel in fluid communication with the pressure relief valve; an ink jet print head having an inlet, a drain outlet and a nozzle plate, the ink jet print head being in fluid communication with the cleaning vessel; a switch valve, the switch valve being in fluid communication with the ink jet print head and a bath; the bath; a filter module in fluid communication with the switch valve; a recirculating pump in fluid communication with the filter module and the cleaning liquid vessel; and a central processing module (CPM), in communication with the pressure pump, the pressure relief valve, the ink jet print head, the switch valve, the filter module, and the recirculating pump, wherein (i) the system further comprises at least one pressure gauge in communication with the filter module, (ii) the CPM is in communication with the pressure gauge, (iii) the CPM further comprises: a user interface module; a display; at least one processor; and a non-volatile memory having thereon a processor-readable medium with a set of executable instructions, (iv) the set of executable instruction is configured, when executed, to cause the at least one processor included in the CPM to: using the pressure pump, pressurize the cleaning fluid vessel, causing cleaning fluid to flow into the ink jet print head's inlet; and actuate the switch valve and the recirculating pump, circulating the cleaning fluid through the filter module, to the cleaning fluid vessel, the ink jet print head inlet, and the ink jet print head drain outlet; then actuate the switch valve, circulating the cleaning fluid through the ink jet print head nozzle plate and into the bath, and from the bath, through the switch valve to the filter module and to the cleaning fluid vessel; and stop the pressure valve, actuate the switch valve, and close the relief valve, circulating the fluid from the bath to the cleaning fluid vessel, (v) the set of executable instruction is further configured, when executed, to cause the at least one processor included in the CPM to repeat the steps of using the pressure pump, pressurize the cleaning fluid vessel, causing cleaning fluid to flow into the ink jet print head's inlet; and actuate the switch valve and the recirculating pump, circulating the cleaning fluid through the filter module, to the cleaning fluid vessel, the ink jet print head inlet, and the ink jet print head drain outlet; then actuate the switch valve, circulating the cleaning fluid through the ink jet print head nozzle plate and into the bath, and from the bath, through the switch valve to the filter module and to the cleaning fluid vessel; and stop the pressure valve, actuate the switch valve, and close the relief valve, circulating the fluid from the bath to the cleaning fluid vessel, for a predetermined number of cycles, wherein (vi) the predetermined number of cycles is between 3 and 10, wherein (vii) the relief valve is at least one of: a mechanical, an electronic, a magnetic, and a spring-loaded valve, and is configured to relieve any pressure above 0.987 Atm, activated by pressure, pressure corresponding temperature, or their combination, further the relief valve can be a pressure relief valve, a pressure release valve, a pressure safety valve, a safety relief valve, a pilot-operated relief valve, a snap acting release valve, a pop-it valve, or a modulating release valve, wherein (viii) the set of executable instruction is further configured, when executed, to cause the at least one processor included in the CPM to actuate at least one of: circulate the cleaning fluid at a fixed time interval for a predetermined period, and circulate the cleaning fluid in response to a signal received from the pressure gauges, wherein (ix) the set of executable instruction is further configured, when executed, to cause the at least one processor included in the CPM to: in response to a signal (referring to one of positive pneumatic or hydraulic pressure or negative pneumatic or hydraulic pressure, where Pneumatic pressure may refer to air or other gaseous (e.g., vapor) pressure, whereas, hydraulic pressure may refer to fluid pressure), received by the CPM, stop the recirculating pump; stop the pressure pump; and using the pressure relief valve, release, or otherwise modulate residual system pressure (referring to the pressure sensed by the pressure gauge(s) to below the predetermined threshold (e.g., 0.987 Atm.), wherein (x) the signal is a pressure increase of more than a predetermined degree (in other words, a predetermined delta for example 0.2-0.5 Bar, or difference between two pressure measurement taken at a fixed interval) in the pressure gauge, or (xi) the signal is a lapse of time of more than a predetermined period, wherein (xii) the filter module comprises a 3 μm (particle cutoff) filter, wherein (xiii) the system further comprises at least one of: an imaging module and a calibration module, the imaging module and the calibration module being operable, each or in combination to detect a clogged nozzle plate, or clogged nozzle(s) at a portion that is less than full nozzle plate, and wherein (xiv) the signal is received from at least one of: the imaging module, and the calibration module, referring for example, to stored operation parameters (e.g., on the same or different memory storage device as the one coupled to the CPM), which are mostly permanent. These parameters are mostly permanent because end-users are typically prevented from adjusting the operation parameters stored in the calibration module (i.e., the calibration parameters). For reference, in comparison, an adjustable operation parameter may include the pressure differential (up or down, that will cause relief valve actuation), which is adjustable by an end user.

In yet another exemplary implementation, provided herein is a computerized method of unclogging an ink jet print head nozzle plate, implementable in a system comprising: a pressure pump, a pressure relief valve in fluid communication with the pressure pump, a cleaning liquid vessel in fluid communication with the pressure relief valve, an ink jet print head having an inlet, a drain outlet and a nozzle plate, the ink jet print head being in fluid communication with the cleaning vessel, a switch valve, the switch valve being in fluid communication with the ink jet print head and a bath, the bath, a filter module in fluid communication with the switch valve, a recirculating pump in fluid communication with the filter module and the cleaning liquid vessel, a pressure gauge in communication with the filter module, and a central processing module (CPM), in communication with the pressure pump, the pressure relief valve, the ink jet print head, the switch valve, the filter module, and the recirculating pump, the method comprising: upon at least one of: at a fixed time interval of the ink jet print head printing; (and/or) receiving a command by the CPM; and/or receiving a signal indicating the ink jet print head nozzle plate, or a predetermined portion thereof (in other words, a portion large enough to determine the PQ is unacceptable) is clogged, activating the pressure pump, and the recirculating pump as well as actuating the switch valve; circulating the cleaning fluid through the ink jet print head inlet to the drain outlet, through the switch valve to the filter module and to the cleaning fluid vessel; actuating the switch valve for circulating the cleaning fluid through the ink jet print head nozzle plate and into the bath; and upon at least one of: a predetermined lapse of time; and receiving a command by the CPM, shutting the pressure pump, actuating the switch valve, and closing the relief valve thus draining the fluid from the bath, through the filter module to the cleaning fluid vessel, wherein (xv), the CPM further comprises: a user interface module; a display; at least one processor; and a non-volatile memory storage device storing thereon a processor-readable medium with a set of executable instructions, configured, when executed to cause the at least one processor to perform the steps of the method disclosed in full, (xvi) the system further comprising at least one of: an imaging module, and a calibration module, the imaging module and the calibration module operable, each or in combination to detect a clogged and unclogged nozzle plate or a portion thereof, and wherein the signal indicating that the ink jet print head's nozzle plate or portion thereof is clogged or unclogged is received from at least one of: the imaging module, and the calibration module, wherein (xvii) the step of actuating the switch valve and the recirculating pump is preceded by: printing a test pattern; and analyzing the test pattern; determining if the nozzle plate or a portion thereof is clogged; and if the nozzle plate or portion thereof is clogged, then coupling the cleaning liquid vessel in fluid communication with the pressure relief valve to the ink jet print head's inlet, and the switch valve, the filter module and the recirculating pump to the drain outlet while placing the bath beneath the ink jet print head's nozzle plate; else using the ink jet print head, the method further comprising (xviii) repeating the steps from actuating the switch valve and the recirculating pump, to the step of actuating the switch valve, and closing the relief valve thus circulating the fluid from the bath to the cleaning fluid vessel for between 3 and 10 cycles, for example between 4 and 8 cycles or between 5 and 7 cycles, wherein (xix) after the last cycle, printing the (same) test pattern (e.g. FIG. 3A); and if the printed test pattern indicates a clogged nozzle plate or portion thereof, repeating the steps of actuating the switch valve and the recirculating pump, to the step of actuating the switch valve, and closing the relief valve thus circulating the fluid from the bath to the cleaning fluid vessel for an additional at least one cycle; else if the print pattern indicates an open nozzle plate or portion thereof, then decoupling the cleaning liquid vessel in fluid communication with the pressure relief valve from the ink jet print head's inlet, and the switch valve, the filter module and the recirculating pump from the drain outlet while removing the bath from beneath the ink jet print head's nozzle plate and resuming use of the ink jet print head, and wherein (xx) the command received by the CPM for at least one of the step of actuating the switch valve and the recirculating pump, and the step of stopping the pressure pump and the recirculating pump is input by a user using the user interface.

While in the foregoing specification the systems and assemblies for cleaning clogged nozzles of ink jet print head under controlled pressure, have been described in relation to certain preferred exemplary implementations, and many details are set forth for purpose of illustration, it will be apparent to those skilled in the art that the disclosure of the assemblies and methods allowing alignment of inkjet print heads by selectably modulating phase, registration, and yaw is susceptible to additional exemplary implementations and that certain of the details described in this specification and as are more fully delineated in the following claims can be varied considerably without departing from the basic principles of this disclosure.

What is claimed:

1. A computerized system for unclogging nozzle plate of an ink jet print head comprising:

a. a pressure pump;
b. a pressure relief valve in fluid communication with the pressure pump;
c. a cleaning fluid vessel in fluid communication with the pressure relief valve;
d. an ink jet print head having an inlet, a drain outlet and a nozzle plate, the ink jet print head being in fluid communication with the cleaning fluid vessel;
e. a switch valve, the switch valve being in fluid communication with the ink jet print head and a bath;
f. the bath;
g. a filter module in fluid communication with the switch valve;
h. a recirculating pump in fluid communication with the filter module and the cleaning fluid vessel; and
i. a central processing module (CPM), in communication with the pressure pump, the pressure relief valve, the ink jet print head, the switch valve, the filter module, and the recirculating pump.

2. The system of claim 1, wherein the system further comprises at least one pressure gauge in communication with the filter module.

3. The system of claim 2, wherein the CPM is in communication with the at least one pressure gauge.

4. The system of claim 3, wherein the CPM further comprises:

a. a user interface module;
b. a display;
c. at least one processor; and
d. a non-volatile memory having thereon a processor-readable medium with a set of executable instructions.

5. The system of claim 4, wherein the set of executable instruction is configured, when executed, to cause the at least one processor included in the CPM to:

a. using the pressure pump, pressurize the cleaning fluid vessel, causing cleaning fluid to flow into the ink jet print head's inlet; and
b. actuate the switch valve and the recirculating pump, circulating the cleaning fluid through the filter module, to the cleaning fluid vessel, the ink jet print head inlet, and the ink jet print head drain outlet;
c. actuate the switch valve, circulating the cleaning fluid through the ink jet print head nozzle plate and into the bath, and from the bath, through the switch valve to the filter module and to the cleaning fluid vessel; and
d. stop the pressure valve, actuate the switch valve, and close the relief valve, circulating the fluid from the bath to the cleaning fluid vessel.

6. The system of claim 5, wherein the set of executable instruction is further configured, when executed, to cause the at least one processor included in the CPM to repeat the steps of claim 5 for a predetermined number of cycles.

7. The system of claim 6 wherein the predetermined number of cycles is between 3 and 10.

8. The system of claim 7 wherein the set of executable instruction is further configured, when executed, to cause the at least one processor included in the CPM to actuate at least one of: circulate the cleaning fluid at a fixed time interval for a predetermined period, and circulate the cleaning fluid in response to a signal received from the at least one pressure gauge.

9. The system of claim 8, wherein the set of executable instruction is further configured, when executed, to cause the at least one processor included in the CPM to:

a. in response to a signal received by the CPM, stop the recirculating pump;

b. stop the pressure pump; and c. using the pressure relief valve, release residual system pressure.

10. The system of claim 9, further comprising at least one of: an imaging module and a calibration module, the imaging module and the calibration module operable, each or in combination to detect a clogged nozzle plate or portion thereof.

11. The system of claim 10, wherein the signal is received from at least one of: the imaging module, and the calibration module.

12. The system of claim 6, wherein the pressure relief valve is configured to relieve any pressure above 0.987 Atm.

13. The system of claim 8, wherein the signal is a pressure increase of more than a predetermined degree in the at least one pressure gauge.

14. The system of claim 13, wherein the signal is a lapse of time of more than a predetermined period.

15. The system of claim 1, wherein the filter module comprises a 3 μm filter.

16. A computerized method of unclogging an ink jet print head nozzle plate, implementable in a system comprising: a pressure pump, a pressure relief valve in fluid communication with the pressure pump, a cleaning fluid vessel in fluid communication with the pressure relief valve, an ink jet print head having an inlet, a drain outlet and a nozzle plate, the ink jet print head being in fluid communication with the cleaning fluid vessel, a switch valve, the switch valve being in fluid communication with the ink jet print head and a bath, the bath, a filter module in fluid communication with the switch valve, a recirculating pump in fluid communication with the filter module and the cleaning fluid vessel, a pressure gauge in communication with the filter module, and a central processing module (CPM), in communication with the pressure pump, the pressure relief valve, the ink jet print head, the switch valve, the filter module, and the recirculating pump, the method comprising:

a. upon at least one of:

i. at a fixed time interval of the ink jet print head printing;

ii. receiving a command by the CPM; and iii. receiving a signal indicating the ink jet print head nozzle plate is clogged activating the pressure pump, and the recirculating pump as well as actuating the switch valve;

b. circulating the cleaning fluid through the ink jet print head inlet to the drain outlet, through the switch valve to the filter module and to the cleaning fluid vessel;

c. actuating the switch valve for circulating the cleaning fluid through the ink jet print head nozzle plate and into the bath; and d. upon at least one of:

i. a predetermined lapse of time; and ii. receiving a command by the CPM, shutting the pressure pump, actuating the switch valve, and closing the relief valve thus draining the fluid from the bath, through the filter module to the cleaning fluid vessel.

17. The method of claim 16, wherein the CPM further comprises:

a. a user interface module;

b. a display;

c. at least one processor; and d. a non-volatile memory storage device storing thereon a processor-readable medium with a set of executable instructions, configured, when executed to cause the at least one processor to perform the steps of claim 16.

18. The method of claim 17, wherein the system further comprises at least one of: an imaging module, and a calibration module, the imaging module and the calibration module operable, each or in combination to detect a clogged and unclogged nozzle plate or a portion thereof, and wherein the signal indicating that the ink jet print head's nozzle plate or a portion thereof is clogged or unclogged is received from at least one of: the imaging module, and the calibration module.

19. The method of claim 18, wherein the step of actuating the switch valve and the recirculating pump is preceded by:

a. printing a test pattern; and b. analyzing the test pattern;

c. determining if the nozzle plate is clogged; and d. if the nozzle plate is clogged, then coupling the cleaning fluid vessel in fluid communication with the pressure relief valve to the ink jet print head's inlet, and the switch valve, the filter module and the recirculating pump to the drain outlet while placing the bath beneath the ink jet print head's nozzle plate; else e. using the ink jet print head.

20. The method of claim 17 wherein the command received by the CPM for at least one of the step of actuating the switch valve and the recirculating pump, and the step of stopping the pressure pump and the recirculating pump is input by a user using the user interface.

21. The method of claim 19, further comprising repeating the steps from actuating the switch valve and the recirculating pump, to the step of actuating the switch valve, and closing the pressure relief valve thus circulating the fluid from the bath to the cleaning fluid vessel for between 3 and 10 cycles.

22. The method of claim 21, further comprising, after a last cycle of the between 3 and 10 cycles, printing the test pattern; and a. if the print pattern indicates a clogged nozzle plate or portion thereof, repeating the steps of actuating the switch valve and the recirculating pump, to the step of actuating the switch valve, and closing the pressure relief valve thus circulating the fluid from the bath to the cleaning fluid vessel for an additional at least one cycle; else b. if the printed test pattern indicates an open nozzle plate or portion thereof, then decoupling the cleaning fluid vessel in fluid communication with the pressure relief valve from the ink jet print head's inlet, and the switch valve, the filter module and the recirculating pump from the drain outlet while removing the bath from beneath the ink jet print head's nozzle plate and resuming use of the ink jet print head.

* * * * *